US008631541B2

(12) United States Patent
Tran

(10) Patent No.: US 8,631,541 B2
(45) Date of Patent: Jan. 21, 2014

(54) AUXILIARY BRUSH FOR VACUUM CLEANER

(75) Inventor: Phong Hoang Tran, Caledonia, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 0 days.

(21) Appl. No.: 13/587,228

(22) Filed: Aug. 16, 2012

(65) Prior Publication Data

US 2013/0047368 A1 Feb. 28, 2013

Related U.S. Application Data

(60) Provisional application No. 61/526,469, filed on Aug. 23, 2011.

(51) Int. Cl.
*A47L 5/00* (2006.01)
*A47L 5/26* (2006.01)

(52) U.S. Cl.
USPC ..... 15/366; 15/368; 15/372; 15/385; 15/392

(58) Field of Classification Search
USPC ..... 15/364, 366, 368, 371, 372, 384, 385, 15/392
IPC ..... A47L 5/00,5/26
See application file for complete search history.

(56) References Cited

U.S. PATENT DOCUMENTS

| | | | | |
|---|---|---|---|---|
| 3,748,679 | A | 7/1973 | Rosendall | |
| 3,750,215 | A | 8/1973 | Liebscher | |
| 3,874,016 | A | 4/1975 | Liebscher | |
| 3,978,539 | A | 9/1976 | Yonkers | |
| 5,331,715 | A * | 7/1994 | Johnson et al. | 15/332 |
| 7,146,682 | B2 * | 12/2006 | Damman et al. | 15/388 |
| 7,610,651 | B2 * | 11/2009 | Baek | 15/345 |

FOREIGN PATENT DOCUMENTS

GB 2213047 A 9/1989

* cited by examiner

*Primary Examiner* — David Redding
(74) *Attorney, Agent, or Firm* — McGarry Bair PC

(57) ABSTRACT

A modular auxiliary brush assembly for a vacuum cleaner includes a mounting bracket coupled to the vacuum cleaner, a spring-biased brush head, and a shaft which mounts the brush head to the mounting bracket. The spring-biased brush head is vertically adjustable to accommodate cleaning surfaces of varied heights and textures. The spring-biased brush head includes a tread which contacts a surface to be cleaned and rolls the brush head relative to the vacuum cleaner when the vacuum cleaner moves over the surface.

12 Claims, 7 Drawing Sheets

AUXILIARY BRUSH FOR VACUUM CLEANER

CROSS-REFERENCE TO RELATED APPLICATION

This application claims the benefit of U.S. Provisional Patent Application No. 61/526,469, filed Aug. 23, 2011, which is incorporated herein by reference in its entirety.

BACKGROUND OF THE INVENTION

Vacuum cleaners can include an agitator for agitating debris on a surface to be cleaned so that the debris is more easily ingested into the vacuum cleaner. In some cases, the agitator comprises a motor-driven brushroll that rotates within a base assembly or floor nozzle. Vacuum cleaners can also include auxiliary agitators for providing additional agitation to the surface to be cleaned. One type of auxiliary agitator is a brush positioned at a side of the vacuum cleaner which acts to sweep dirt and debris into the suction path of the vacuum cleaner. Examples of these side brushes are shown in U.S. Pat. No. 3,748,679 to Rosendall, issued Jul. 31, 1973; U.S. Pat. No. 3,750,215 to Liebscher, issued Aug. 7, 1973; U.S. Pat. No. 3,874,016 to Liebscher, issued Apr. 1, 1975; U.S. Pat. No. 3,978,539 to Yonkers, issued Sep. 7, 1976; and U.K. Patent Application No. 2,213,047 to Brougham-Packard, published Aug. 9, 1989.

BRIEF DESCRIPTION OF THE INVENTION

A vacuum cleaner according to the invention comprises a housing having a suction nozzle, a source of suction in fluid communication with the suction nozzle for generating a working air stream through the housing, and a brush assembly provided on the housing outside the suction nozzle and configured to sweep dirt toward a suction path of the vacuum cleaner defined by the suction nozzle. The brush assembly comprises a shaft attached to the housing, a brush head for contacting the surface to be cleaned and rotatably mounted about the shaft, and a spring biasing the brush head away from the housing, wherein the spring-biased brush head adjusts to accommodate variations in the height and/or texture of the surface to be cleaned as the housing is moved over the surface to be cleaned.

DETAILED DESCRIPTION

The present invention relates generally to an auxiliary brush for the foot or base of a vacuum cleaner. For purposes of description related to the figures, the terms "upper," "lower," "right," "left," "rear," "front," "vertical," "horizontal," "inner," 'outer," and derivatives thereof shall relate to the invention as oriented in FIG. 1 from the perspective of a user behind the vacuum cleaner, which defines the rear of the vacuum cleaner. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
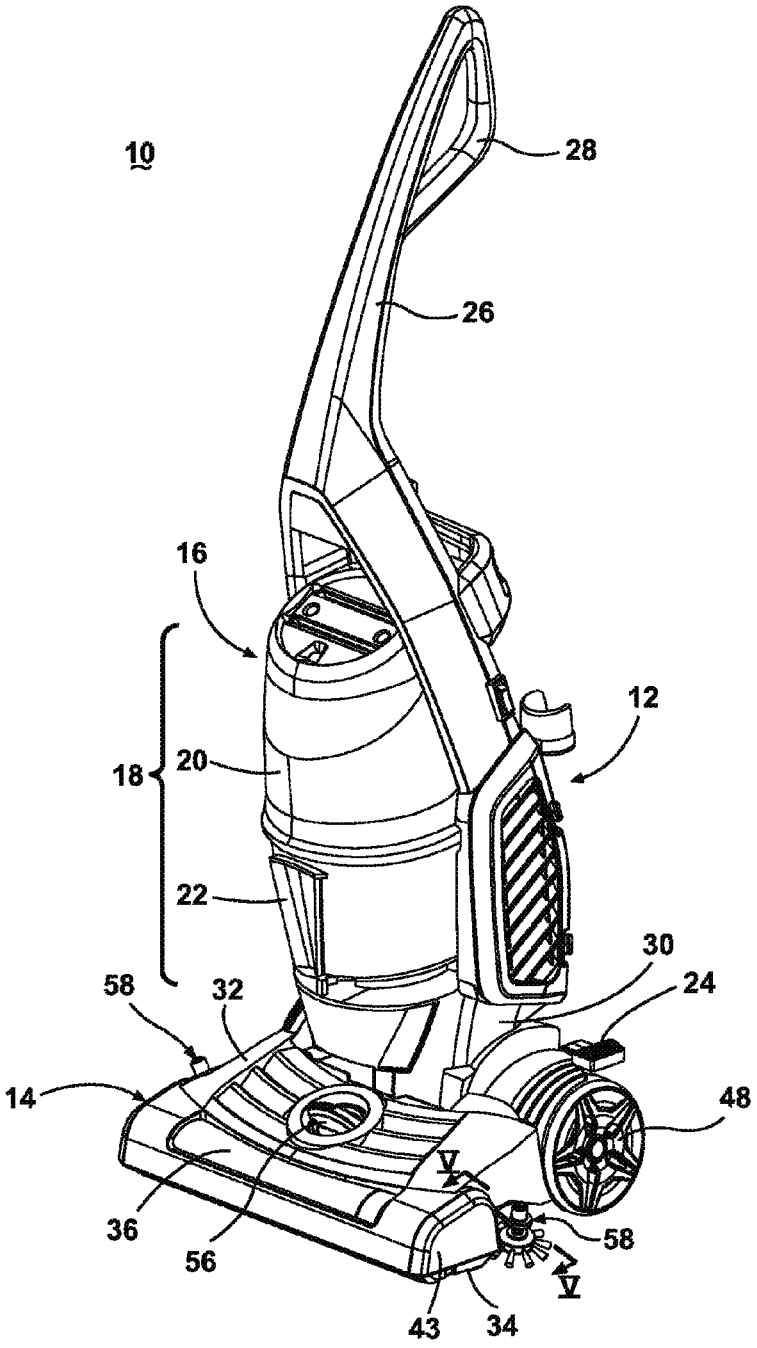
FIG. 1 is a front perspective view of a vacuum cleaner with base assembly pivotally attached to an upright handle assembly, with base assembly having a pair of auxiliary brush assemblies according to one embodiment of the invention.

FIG. 1 is a perspective view of a vacuum cleaner 10 according to a first embodiment of the invention. As illustrated, the vacuum cleaner 10 comprises an upright handle assembly 12 pivotally mounted to a base assembly 14. The upright handle assembly 12 generally comprises a main body 16 housing a collection system 18 for separating and collecting contaminants from a working airstream for later disposal. In one conventional arrangement illustrated herein, the collection system 18 can include a cyclone separator 20 for separating contaminants from a working airstream and a removable dirt cup 22 for receiving and collecting the separated contaminants from the cyclone separator 20. In another conventional arrangement, the collection system 18 can include an integrally formed cyclone separator and dirt cup, with the dirt cup being provided with a bottom-opening dirt door for contaminant disposal. In yet another conventional arrangement, the collection system 18 can include a filter bag. The vacuum cleaner 10 can also be provided with one or more additional filters upstream or downstream of the collection system 18.

The upright handle assembly 12 is pivotally mounted to the base assembly 14 for movement between an upright storage position, shown in FIG. 1, and a reclined use position (not shown). The vacuum cleaner 10 can be provided with a detent mechanism, such as a pedal 24 pivotally mounted to the base assembly 14, for selectively releasing the upright handle assembly 12 from the storage position to the use position. The details of such a detent pedal 24 are commonly known in the art, and will not be discussed in further detail herein.

The main body 16 also has an upwardly extending handle 26 that is provided with a hand grip 28 at one end that can be used for maneuvering the vacuum cleaner 10 over a surface to be cleaned. A motor cavity 30 is formed at a lower end of the main body 16 and contains a conventional suction source (not shown), such as a motor/fan assembly, positioned therein in fluid communication with the collection system 18. In operation, the vacuum cleaner 10 draws in dirt-laden air through the base assembly 14 and into the collection system 18 where the dirt is substantially separated from the working air. The air flow then passes through the motor cavity 30 and past the suction source prior to being exhausted from the vacuum cleaner 10. A suitable upright handle assembly 12 is more fully described in detail in U.S. Pat. No. 7,708,789 to Fester, which is incorporated herein by reference in its entirety.

Figure 2:
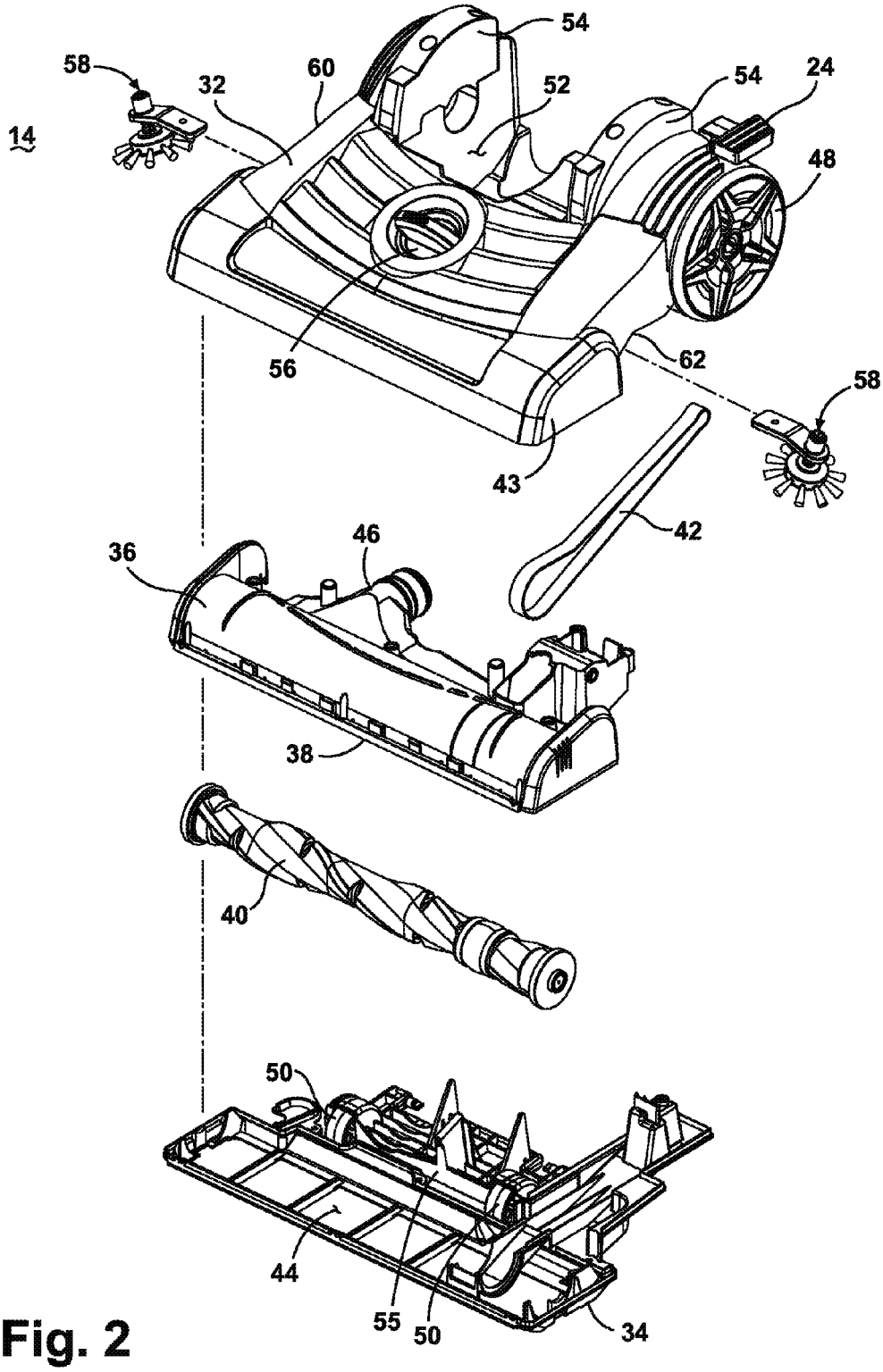
FIG. 2 is a partially exploded view of the base assembly having a pair of auxiliary brush assemblies of FIG. 1.

FIG. 2 is a partially exploded view of the base assembly 14 from FIG. 1. The base assembly 14 includes an upper housing 32 that couples with a lower housing 34 to create a partially enclosed space therebetween. As illustrated herein, the lower housing 34 can comprise a sole plate for the vacuum cleaner 10. An agitator casing 36 is positioned within the upper housing 32 and mates with a portion of the sole plate 34 to create an agitator chamber 38 at a forward portion of the upper housing 32. An agitator 40 is positioned within the agitator chamber 38 for rotational movement, and can be coupled to the motor/fan assembly in the motor cavity 30 (FIG. 1) via a commonly known arrangement including a drive belt 42. Alternatively, a dedicated agitator motor can be provided in the base assembly 14 for driving the agitator 40. The agitator 40 is illustrated as a rotatable brushroll; however, it is within the scope of the invention for other types of agitators to be used, such as a stationary brush or dual rotating brushrolls. The upper housing 32 can have a wider front section 43 for receiving the agitator casing 36.

A suction nozzle opening 44 is formed in the lower housing 34 in fluid communication with the agitator chamber 38. A duct 46 is coupled at one end to the agitator casing 36 and fluidly communicates the suction nozzle opening 44 with the collection system 18 (FIG. 1). A pair of rear wheels 48 is provided on the upper housing 32 and a pair of front wheels 50 can be provided on the lower housing 34 for maneuvering the vacuum cleaner 10 over a surface to be cleaned. The upper housing 32 further includes a rear cavity 52 for receiving the motor cavity 30 of the upright handle assembly 12. A pair of clamps 54 pivotally secures the upright handle assembly 12 to the upper housing 32. Other common features of vacuum cleaner base assemblies, such as a suction nozzle height adjustment mechanism, can be provided. Other common features of vacuum cleaner base assemblies, such as a suction nozzle height adjustment mechanism comprising a rotatable carriage 55 of the lower housing 34 attached to the upper housing 32 on which the front wheels 50 are mounted and which is actuated by a knob 56, can be provided.

The vacuum cleaner 10 further comprises at least one auxiliary brush assembly 58 mounted to the side of the base assembly 14. The auxiliary brush assembly 58 provides a secondary agitation of the surface to be cleaned, i.e. in addition to the primary agitation provided by the agitator 40. The auxiliary brush assembly 58 acts to sweep dirt and debris toward the suction path of the vacuum cleaner defined by the suction nozzle opening 44. For example, the auxiliary brush assembly 58 can be configured to clean areas beyond the cleaning path of the base assembly 14, such as along baseboards of rooms and along kick plates of cabinetry and appliances. The auxiliary brush assembly 58 can be modular, in that the assembly 58 can be a self-contained unit composed of standardized units for easy construction and installation on the vacuum cleaner 10 or on other vacuum cleaners. As shown herein, two auxiliary brush assemblies 58 are provided on the base assembly 14, and extend outwardly from a right side 60 and a left side 62 of the base assembly 14, behind the agitator 40 in the base assembly 14. The right and left sides 60, 62 may extend rearwardly of the front section 43, and the width of the upper housing 32 between the right and left sides 60, 62 may be narrower than the front section 43.

Figure 3:
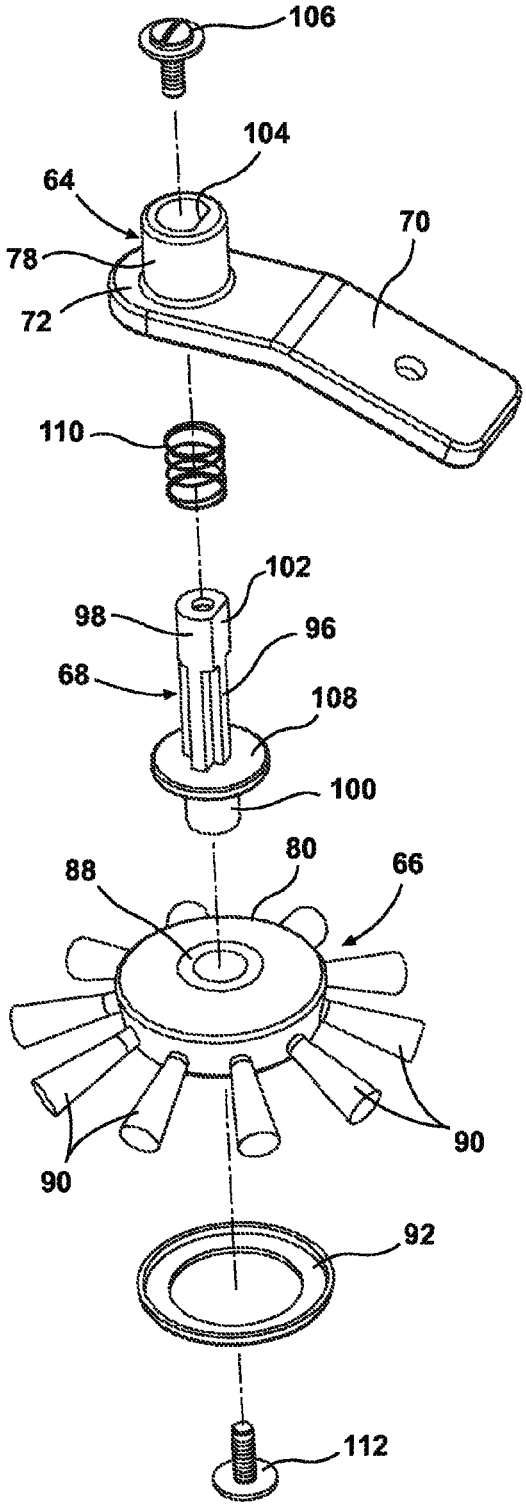
FIG. 3 is an exploded view of one of the auxiliary brush assemblies of FIG. 2.
Figure 4:
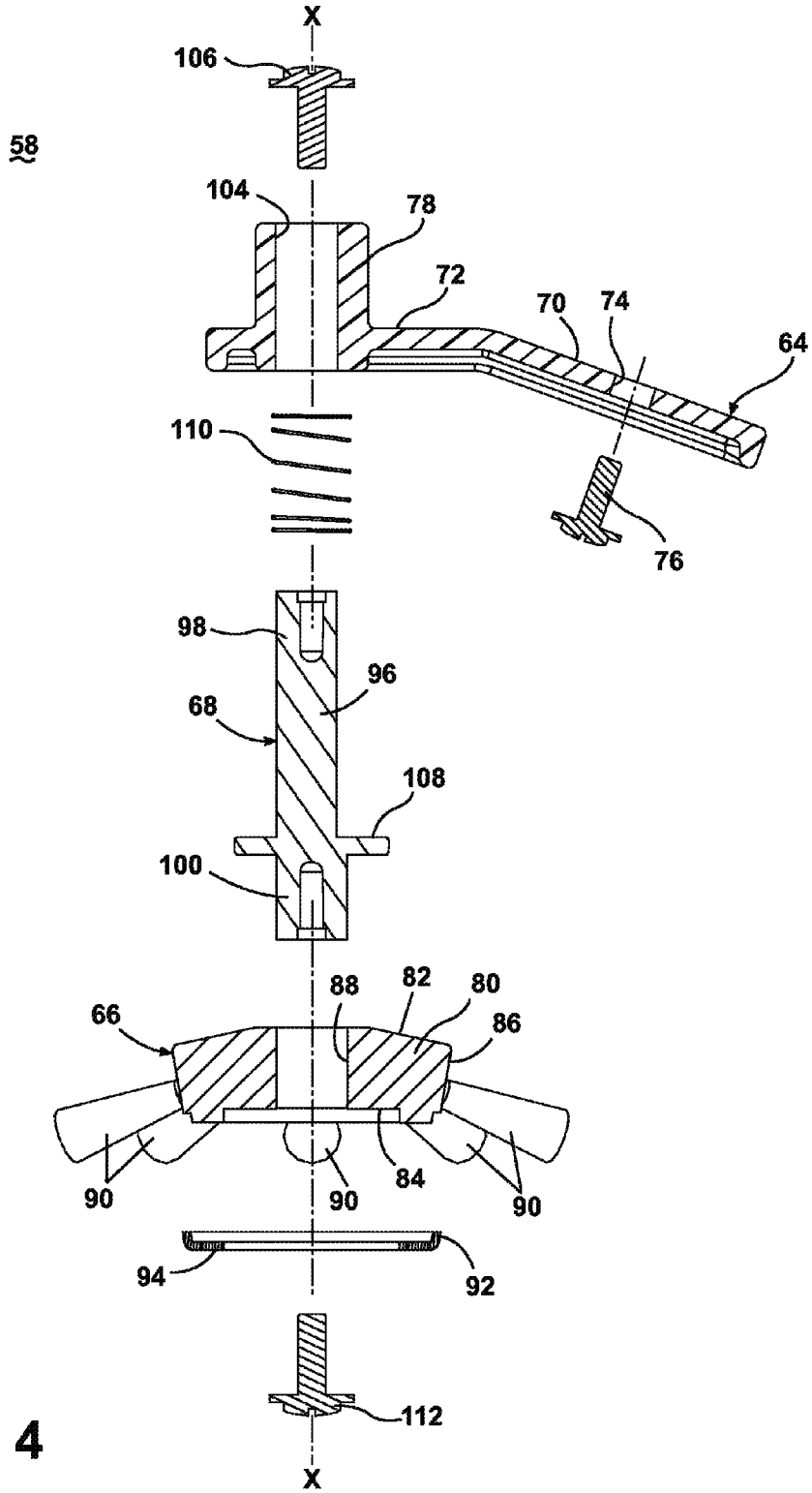
FIG. 4 is an exploded sectional view of one of the auxiliary brush assemblies of FIG. 2.

FIGS. 3 and 4 are an exploded and exploded sectional view of one of the auxiliary brush assemblies 58 of FIG. 2. The auxiliary brush assembly 58 comprises a mounting bracket 64, a translatable and rotatable brush head 66, and a brush shaft 68 which mounts the brush head 66 to the mounting bracket 64. The mounting bracket 64 comprises two plates joined or formed at an angle with respect to each other, an inner base plate 70 and an outer brush plate 72. The inner base plate has an opening 74 which receives a fastener 76 for mounting the auxiliary brush assembly 58 to the base assembly 14. The angle between the two plates 70, 72 can be configured such that the brush plate 72 is oriented at an angle with respect to the surface to be cleaned when the base plate 70 is mounted to the base assembly 14. As shown herein, the plates 70, 72 are formed at an obtuse angle relative to each other. The brush plate 72 comprises a sleeve 78 that extends through and above the brush plate 72.

The brush head 66 comprises a central hub 80 having an upper surface 82, a lower surface 84, and a perimeter surface 86 therebetween. A bore 88 extends through the upper and lower surfaces 82, 84 of the hub 80. A plurality of bristle tufts 90 are provided on the hub 80, and, in the illustrated embodiment, project radially outwardly from the perimeter surface 86 of the hub 80. Other configurations of the bristle tufts 90 are possible, such as, but not limited to, the bristle tufts 90 being provided in one continuous group around the hub 80 instead of discrete groups as shown herein, or some or all of the bristle tufts 90 extending from other portions of the hub 80, such as the upper and lower surfaces 82, 84. The hub 80 can be made from a rigid material and the bristle tufts 90 can be made from a flexible material. A tread 92 is provided around the lower edge of the central hub 80 and covers an outer portion of the lower surface 84 and a lower portion of the perimeter surface 86. The tread 92 can be made from an elastomeric material that is adhered to, over-molded, or otherwise secured around a lower perimeter of the hub 80 to provide a relatively high coefficient of friction contact surface 94 that rolls along the surface to be cleaned. The contact surface 94 provides a frictional engagement of the surface to be cleaned and cooperates with the brush shaft 68 and sleeve 78 to convert linear movement of the vacuum cleaner into rotational movement of the brush head 66. The material for the contact surface 94 can be selected to provide sufficient frictional engagement with various types of floor surfaces without slipping.

The shaft 68 comprises an elongated body 96 having a top end portion 98 and a bottom end portion 100 and defining a shaft axis X. The sleeve 78 on the mounting bracket 64 slidingly receives the top end portion 98 of the shaft 68 therein, such that the shaft 68 can slide relative to the mounting bracket 64 along the shaft axis X. The shaft 68 can be keyed to the sleeve 78 to prevent rotation of the shaft 68 relative to the sleeve 78. As shown herein, the top end portion 98 of the shaft 68 has a D-shaped profile 102 that coincides with a corresponding D-shaped inner surface 104 of the sleeve 78. A fastener 106, shown herein as a washer head screw, is fastened to the top end portion 98 of the shaft 68 to limit the downward translation of the shaft 68 relative to the sleeve 78. A flange 108 extends from the body 96 of the shaft 68, and can be positioned closer to the bottom end portion 100 than the top end portion 98. A coil spring 110 is compressed between the bottom of the mounting bracket 64 and the flange 108 to normally bias the shaft 68 downwardly to a lower limit of the shaft 68 in which the washer head screw 106 contacts the top of the sleeve 78. The brush head 66 is fastened to the bottom end portion 100 of the shaft 68 so that the top of the central hub 80 abuts the bottom surface of the flange 108. A fastener 112, shown herein as a single screw, is used to secure the brush head 66 to the shaft 68. However, other fastening arrangements, such as snap fits, are contemplated for use with the auxiliary brush assembly 58.

Figure 5:
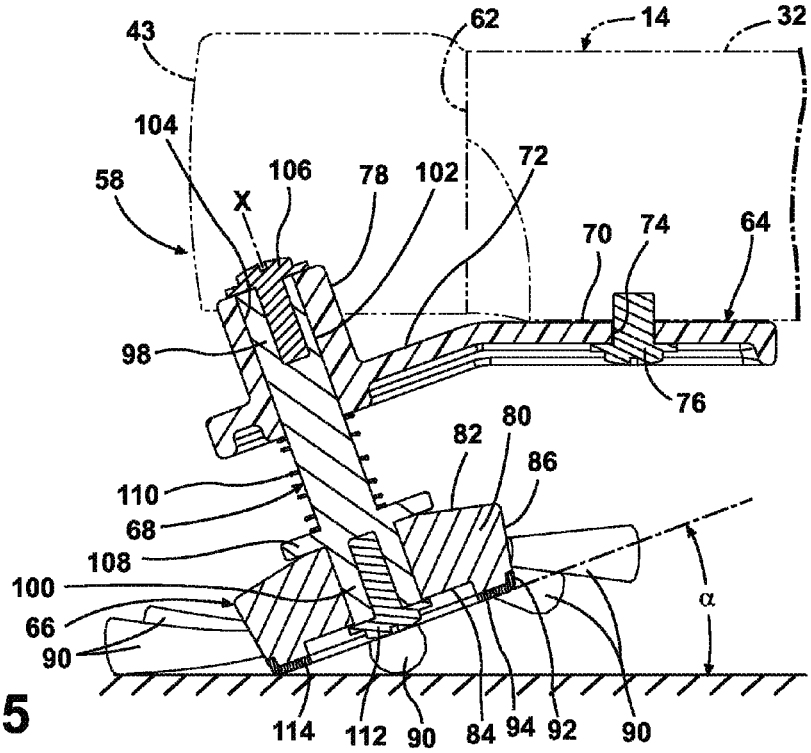
FIG. 5 is a cross-sectional view through line V-V of FIG. 1, illustrating the auxiliary brush assembly in a lowermost position and in engagement with a surface to be cleaned.

FIG. 5 is a cross-sectional view through line V-V of FIG. 1, illustrating the engagement of the auxiliary brush assembly 58 with a surface S to be cleaned. The auxiliary brush assembly 58 can be fastened beneath the upper housing 32 of the base assembly 14 so that the bristle tufts 90 extend outwardly beyond the sides (of which only the left side 62 is visible in FIG. 5) of the base assembly 14 and the contact surface 94 of the tread 92 is in register with the surface S and biased downwardly against the surface S by the coil spring 110. However, the central hub 80 of the brush head 66 may be aligned with the outer side or end caps of the front section 43 of the upper housing 32 so that it does not catch on walls, baseboards, or other room features during use. The angled mounting bracket 64 cants the brush head 66 at an acute angle $\alpha$ relative to the surface S so that only an outermost and lower most portion of the tread contact surface 94, which can be referred to as the contact patch 114 of the tread 92, is in register with the surface S. In one non-limiting example, the angle $\alpha$ can be approximately 15-20 degrees.

Figure 6:
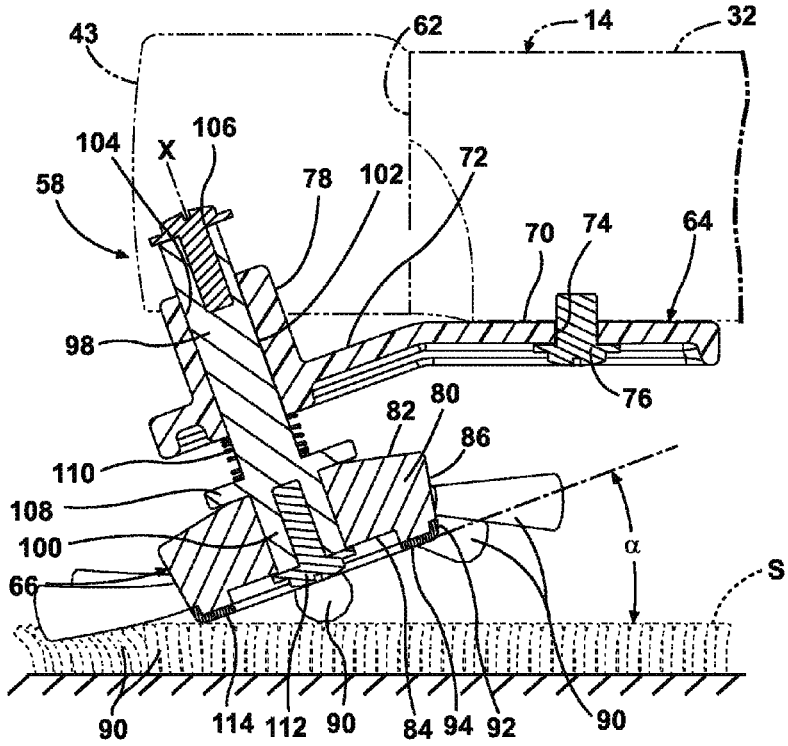
FIG. 6 is a cross-sectional view similar to FIG. 5, illustrating the auxiliary brush assembly in an uppermost position and in engagement with a surface to be cleaned.

In operation, as a user pushes and pulls the vacuum cleaner 10 across the surface S to be cleaned, the spring-biased brush head 66 vertically adjusts along the shaft axis X to accommodate the height and/or texture of the surface S to be cleaned. A lower limit of the shaft 68 is shown in FIG. 5, in which the washer head screw 106 contacts the top of the sleeve 78 and the brush head 66 is in a lowermost position. An upper limit of the shaft 68 is shown in FIG. 6, in which the coil spring 110 is fully or near-fully compressed between the flange 108 and the mounting bracket 68, and the brush head 66 is in an uppermost position. The brush head 66 can vertically translate along the axis X of the shaft 68 between the lowermost and uppermost positions as needed to accommodate surfaces S of varied heights and textures. In order words, the auxiliary brush assembly 58 is configured to automatically adjust the vertical position of the brush head 66 relative to the cleaning surface in accordance with the surface S to be cleaned. For example, on a bare floor, the brush head 66 may ride at or near the lowermost position shown in FIG. 5, while on a carpet having a deep pile, the brush head 66 may ride at or near the uppermost position shown in FIG. 6.

Also during operation, as a user pushes and pulls the vacuum cleaner 10 across the surface S to be cleaned, the tacky contact patch 114 of the tread 92 contacts the surface S and rolls the brush head 66 relative to the base assembly 114. The bristle tufts 90 engaged and/or flex against the surface S and sweep dirt toward the main cleaning path of the vacuum cleaner 10, which is defined by the suction nozzle opening 44.

Figure 7:
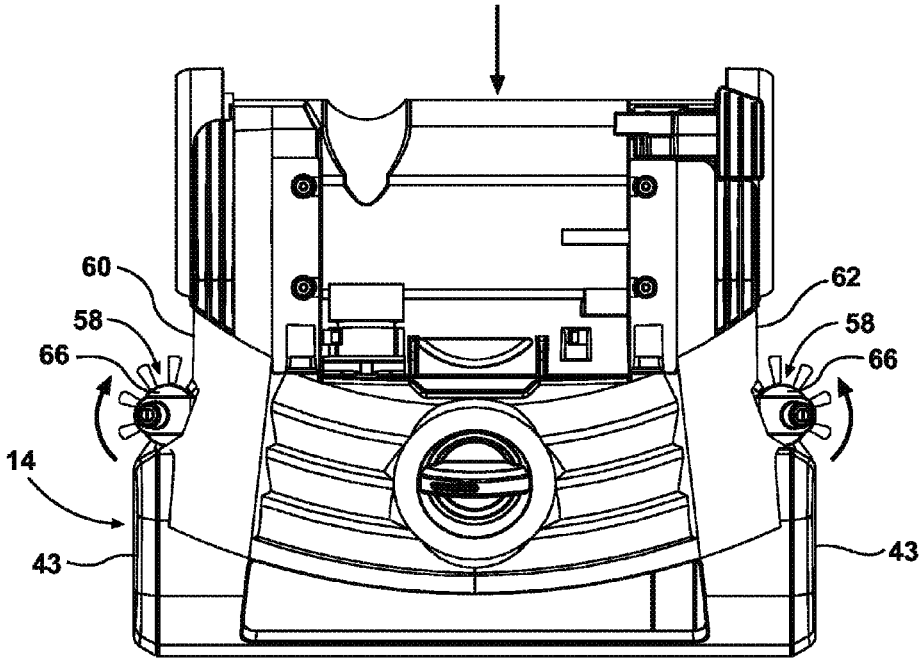
FIG. 7 is a top view of the base assembly, illustrating the rotation of the auxiliary brush assemblies during a forward stroke of the vacuum cleaner.
Figure 8:
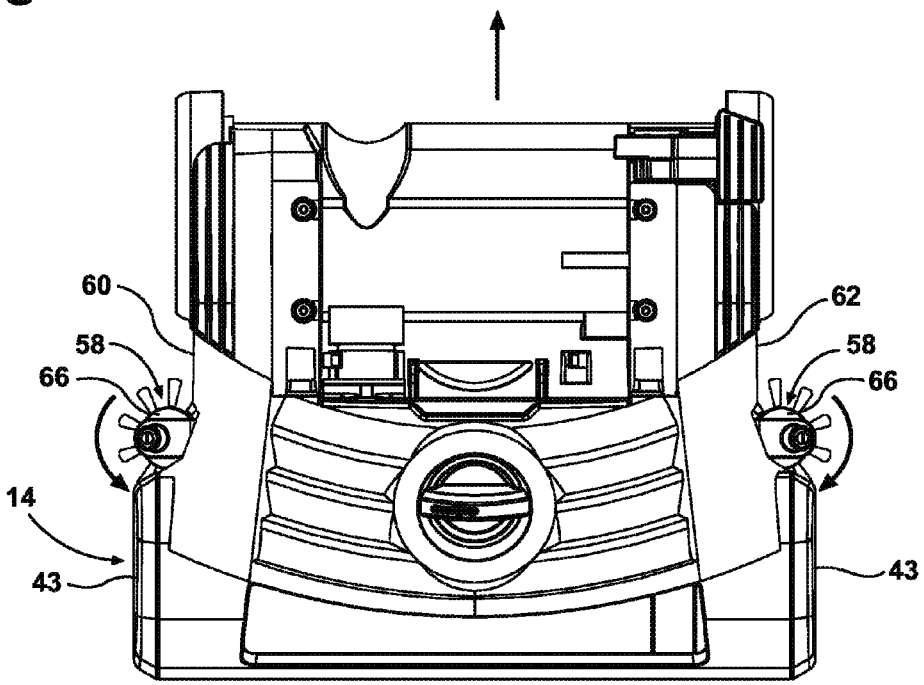
FIG. 8 is a top view of the base assembly, illustrating the rotation of the auxiliary brush assemblies during a backward stroke of the vacuum cleaner.

A user need only operate the vacuum cleaner 10 in familiar manner in order to effect rotation of the auxiliary brush assemblies 58. Referring to FIG. 7, during a forward stroke of the base assembly 14, the brush head 66 of the auxiliary brush assembly 58 mounted on the right side 60 of the base assembly 14 will spin clockwise when viewed from the top and the brush head 66 of the auxiliary brush assembly 58 mounted on the left side 62 of the base assembly 14 will spin counterclockwise when viewed from the top. Referring to FIG. 8, during a backward stroke of the base assembly 14, the brush head 66 of the auxiliary brush assembly 58 mounted on the right side 60 of the base assembly 14 will spin counterclockwise when viewed from the top and the brush head 66 of the auxiliary brush assembly 58 mounted on the left side 62 of the base assembly 14 will spin clockwise when viewed from the top.

Figure 9:
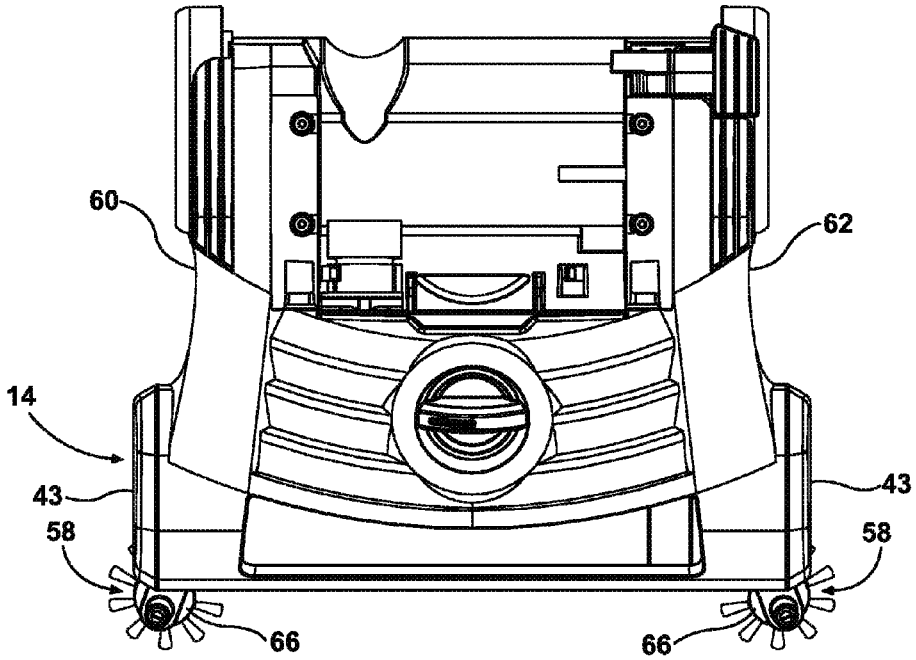
FIG. 9 shows a second embodiment of the invention, in which the auxiliary brush assembly is mounted to the front of the agitator in the base assembly.
Figure 10:
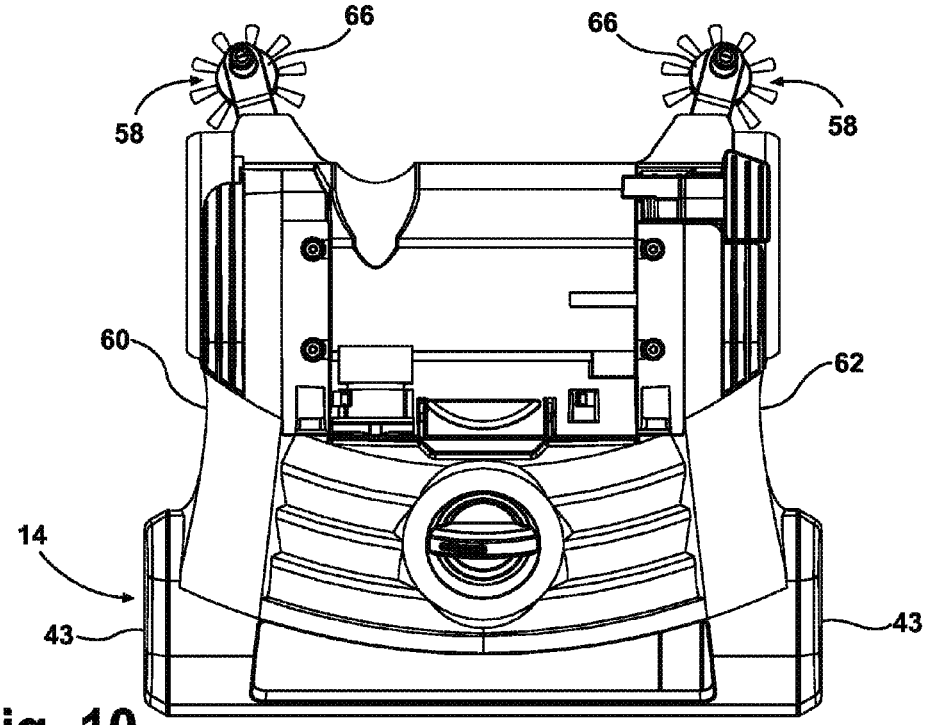
FIG. 10 shows a third embodiment of the invention, in which the auxiliary brush assembly is mounted behind the rear wheel of the base assembly.

While the vacuum cleaner 10 is shown as having two auxiliary brush assemblies 58 mounted to the right and left sides 60, 62 of the base assembly 14, other numbers and positions of the auxiliary brush assemblies are possible. For example, the vacuum cleaner 10 could be provided with only one auxiliary brush assembly 58 fixed on one side of the base assembly 14 or interchangeably mountable on either side of the base assembly 14. Alternatively, the vacuum cleaner 10 could be provided with more than two auxiliary brush assemblies 58. FIG. 9 shows another embodiment of the invention, in which auxiliary brush assemblies 58 are mounted in front of the agitator 40 in the base assembly 14. Specifically, the auxiliary brush assemblies 58 are shown to be mounted at or near the front corners of the base assembly 14. FIG. 10 shows another embodiment of the invention, in which auxiliary brush assemblies 58 are mounted behind the rear wheel 48 of the base assembly 14. Specifically, the auxiliary brush assemblies 58 are shown to be mounted at or near the rear corners of the base assembly 14.

The auxiliary brush assembly 58 offers a low-cost, modular component that can be easily applied across various vacuum cleaner platforms to increase the cleaning range of the vacuum cleaner by cleaning areas not typically reached by the main agitator and suction nozzle. The auxiliary brush assembly 58 can be provided in a pre-assembled modular package that can be installed on the vacuum cleaner 10 using a single fastener, such as the screw or a snap fit. Because the brush head 66 is spring loaded and vertically movable along the shaft axis X, the auxiliary brush assembly 58 is adapted to accommodate different floor surfaces, such as bare floor and carpet having a wide variety of pile depths. The high coefficient contact surface 94 on the bottom tread 92 of the brush heads 66 effect automatic rotation of the brush heads 66 during normal operation of the vacuum cleaner 10.

While the invention has been specifically described in connection with certain specific embodiments thereof, it is to be understood that this is by way of illustration and not of limitation, and the scope of the appended claims should be construed as broadly as the prior art will permit. The illustrated vacuum cleaner is but one example of the variety of vacuum cleaners with which this invention or some slight variant can be used. While shown and described for use with an upright vacuum cleaner, the auxiliary brush assembly 58 can be used with other types of vacuum cleaner, such as sweepers, "stick"-type upright cleaners, canister vacuum cleaners, robotic vacuum cleaners, hand-held vacuum cleaners, or built-in central vacuum cleaning systems. For example, in a canister vacuum cleaner, the base assembly 14 can be configured as a floor nozzle that is coupled to a canister body via a wand-type handle and a vacuum cleaner hose. In cases of vacuum cleaners having hand-held tools, the auxiliary brush assembly 58 could be implemented on the tool itself. The auxiliary brush assembly 58 can also be used with vacuum cleaners adapted to dispense and/or take up fluids, such as extractors and steam cleaners. Reasonable variation and modification are possible within the forgoing disclosure and drawings without departing from the scope of the invention which is defined by the appended claims. It should also be noted that all elements of all of the claims may be combined with each other in any possible combination, even if the combinations have not been expressly claimed.

What is claimed is:

1. A vacuum cleaner for cleaning a surface, comprising:

a housing having a suction nozzle;

a source of suction in fluid communication with the suction nozzle for generating a suction path through the housing; and a brush assembly provided on the housing outside the suction nozzle and configured to sweep dirt toward the suction path, the brush assembly comprising:

a shaft attached to the housing;

a brush head for contacting the surface to be cleaned and rotatably mounted about the shaft;

a mounting bracket attached to the housing, wherein the shaft mounts the brush head to the mounting bracket, the mounting bracket comprising a sleeve that receives the shaft therein, such that the shaft can slide relative to the mounting bracket; and a spring biasing the brush head away from the housing;

wherein the spring-biased brush head adjusts to accommodate variations in the height and/or texture of the surface to be cleaned as the housing is moved over the surface to be cleaned; and wherein the shaft is keyed to the sleeve to prevent rotation of the shaft relative to the sleeve.

2. The vacuum cleaner from claim 1, wherein the spring is provided between the mounting bracket and the brush head for biasing the brush head away from the mounting bracket.

3. The vacuum cleaner from claim 1, wherein the mounting bracket is angled to cant the brush head at an acute angle relative to the surface to be cleaned so that an outermost portion of the brush head relative to the housing is lower than an inner most portion of the brush head relative to the housing.

4. The vacuum cleaner from claim 1, wherein the brush head comprises a tread defining a contact surface configured to roll along the surface to be cleaned and convert linear movement of the vacuum cleaner into rotational movement of the brush head.

5. The vacuum cleaner from claim 1, wherein the brush head comprises a plurality of bristle tufts.

6. The vacuum cleaner from claim 1, wherein the housing further comprises an agitator chamber in fluid communication with the suction nozzle and an agitator positioned within the agitator chamber.

7. The vacuum cleaner from claim 6, wherein the agitator comprises at least one rotatable brushroll.

8. The vacuum cleaner from claim 6, wherein the brush head is positioned rearwardly of the agitator.

9. The vacuum cleaner from claim 1, wherein two brush assemblies are provided on the housing, and extend outwardly from opposite sides of the housing.

10. The vacuum cleaner from claim 1, further comprising a handle assembly pivotally mounted to the housing.

11. The vacuum cleaner from claim 1, wherein the brush assembly is a modular, self-contained unit installed on the housing one of a single screw and a snap-fit.

12. The vacuum cleaner from claim 1, wherein the shaft defines a shaft axis, and the brush head is rotatably mounted on the shaft for movement about the shaft axis, wherein the spring-biased brush head adjusts along the shaft axis.

* * * * *

UNITED STATES PATENT AND TRADEMARK OFFICE

CERTIFICATE OF CORRECTION

PATENT NO. : 8,631,541 B2
APPLICATION NO. : 13/587228
DATED : January 21, 2014
INVENTOR(S) : Tran It is certified that error appears in the above-identified patent and that said Letters Patent is hereby corrected as shown below:

IN THE CLAIMS:

Column 8, Claim 11, line 24, reads: "housing one of a single screw and a snap-fit."

It should read "…housing using one of a single screw and a snap-fit."

Signed and Sealed this
Sixteenth Day of September, 2014

Michelle K. Lee

Michelle K. Lee
*Deputy Director of the United States Patent and Trademark Office*